United States Patent [19]

Davis

[11] 4,336,689

[45] Jun. 29, 1982

[54] PROCESS FOR DELIVERING LIQUID CRYOGEN

[75] Inventor: Robert B. Davis, Nyack, N.Y.

[73] Assignee: Union Carbide Corporation, Danbury, Conn.

[21] Appl. No.: 282,256

[22] Filed: Jul. 10, 1981

[51] Int. Cl.[3] ..... F17C 7/02

[52] U.S. Cl. ..... 62/55; 137/14

[58] Field of Search ..... 62/55; 137/14

[56] References Cited

U.S. PATENT DOCUMENTS

| | | | |
|---|---|---|---|
| 2,958,205 | 11/1960 | McConkey | 62/55 |
| 4,024,724 | 5/1977 | Dimenebers | 62/55 |
| 4,198,828 | 4/1980 | Mercier et al. | 62/55 |

*Primary Examiner*—Ronald C. Capossela
*Attorney, Agent, or Firm*—Saul R. Bresch

[57] ABSTRACT

A process for delivering a liquid cryogen to a use point in an essentially liquid phase at an about constant flow rate in the range of about 1 to about 40 pounds per hour, said use point having a variable internal pressure drop, comprising the following steps:

(i) providing said liquid cryogen at a line pressure in the range of about 4 to about 10 times the maximum use point operating pressure;

(ii) subcooling the liquid cryogen of step (i) to an equilibrium pressure of no greater than about one atmosphere while maintaining said ine pressure;

(iii) passing the liquid cryogen of step (ii) through a device having a flow coefficient in the range of about 0.0002 to about 0.005 while cooling said device externally to a temperature, which will maintain the liquid cryogen in essentially the liquid phase; and (iv) passing the liquid cryogen exiting the device in step (iii) through an insulated tube having an internal diameter in the range of about 0.020 inch to about 0.200 inch to the use point.

2 Claims, No Drawings

PROCESS FOR DELIVERING LIQUID CRYOGEN

FIELD OF THE INVENTION

This invention relates to a process for the delivery of a cryogen to a use point in essentially liquid forms.

DESCRIPTION OF THE PRIOR ART

In certain cryogenic applications, such as wire die cooling, it is imperative that a means be made available to supply a very small, constant flow of a cryogenic fluid, in essentially the liquid phase, to a use point, e.g., a die, which has an internal pressure drop such as that occasioned by the presence of heat exchange passages and which may be subjected to varying heat loads. Optimally, the liquid is supplied without the two phase vapor/liquid surges normally associated with the movement of cryogen and a steady mass flow of cryogen is maintained through the die.

In order to accomplish the delivery of essentially liquid cryogen to a use point, the use of a temperature operated flow control valve or a positive displacement, high pressure pump has been suggested, but both are considered to raise a problem efficiencywise, and have the further disadvantage of being complicated devices, which would have to be custom-made for the application.

SUMMARY OF THE INVENTION

An object of this invention, therefore, is to provide a process for the delivery of a cryogen in essentially liquid form at a very small, contant flow in spite of internal pressure drop and varying heat load at the use point, the process to be such that it can be accomplished with simple, unsophisticated equipment.

Other objects and advantages will become apparent hereinafter.

According to the present invention, a process has been discovered for delivering a liquid cryogen to a use point in an essentially liquid phase at an about constant flow rate in the range of about 1 to about 40 pounds per hour, said use point having a variable internal pressure drop, comprising the following steps:

(i) providing said liquid cryogen at a line pressure in the range of about 4 to about 10 times the maximum use point operating pressure;

(ii) subcooling the liquid cryogen of step (i) to an equilibrium pressure of no greater then about one atmosphere while maintaining said line pressure;

(iii) passing the liquid cryogen of step (ii) through a device having a flow coefficient in the range of about 0.0002 to about 0.005 while cooling said device externally to a temperature, which will maintain the liquid cryogen in essentially the liquid phase; and (iv) passing the liquid cryogen exiting the device in step (iii) through an insulated tube having an internal diameter in the range of about 0.020 inch to about 0.200 inch to the use point.

DESCRIPTION OF THE PREFERRED EMBODIMENT

As noted above, the process finds utility in, among other things, the provision of liquid cryogen to a wire die cooling apparatus. Such an apparatus and a process for wire die cooling is described in U.S. patent application Ser. No. 282,255 entitled "Process for Wire Die Cooling" filed in the name of Jaak S. Van den Sype on even date herewith. This application is incorporated by reference herein.

The stated objective of subject process is to deliver the cryogen, which may be liquid nitrogen, liquid argon, or liquid helium, for example, in an "essentially liquid phase". This means that the liquid cryogen will contain no more than about 10 percent cryogen in the vapor phase, and preferably no more than about 1 percent vapor, for the process to achieve its goal. The low constant flow rate can be in the range of about 1 to about 40 pounds per hour and is preferably in the range of about 4 to about 20 pounds per hour. The term "constant" used with regard to flow rate means that the flow rate will be maintained within plus or minus ten percent of the desired flow rate and preferably within plus or minus five percent.

The process is designed to overcome a variable pressure drop at the use point ranging from about 25 pounds per square inch (psi) to about 5 psi.

The supply (or line) pressure of the liquid cryogen referred to in step (i) is in the range of about 4 to about 10 times the maximum use point operating pressure (measured in psig) and preferably in the range of about 8 to about 10 times the maximum. The line pressure is the pressure under which the cryogen is stored in a tank or cylinder. This pressure is essentially maintained until step (iii) when the cryogen passes through the throttling device. Maximum use point operating pressures are the highest which will sustain normal operating pressure at the use point together with good heat transfer efficiency. Typical use point operating pressures which can be serviced by this process, in view of the low flow rate, are in the range of about 5 psig to about 40 psig. Use point operating pressures are usually measured at the inlet.

Step (ii) deals with subcooling with liquid cryogen. The term "subcooling" means that the liquid cryogen is maintained in the liquid state, i.e., there is essentially no vaporization. This is accomplished by controlling the equilibrium pressure (vapor pressure) of the liquid cryogen at no greater than about one atmosphere. It will be understood by those skilled in the art that 1.5 atmospheres and even higher can be used if liquid is sacrificed to vapor, but these higher equilibrium pressures detract from the process and are not recommended. Also, extremely low pressures such as those which can be achieved by a vacuum will cause solidification of the liquid cryogen. These low equilibrium pressures of less than about 0.1 atmosphere are excluded by the definition of subcooling, however. The line pressure is maintained here in order to drive the liquid to the use point. Subcooling is effected by passing the liquid cryogen through a heat exchange coil, e.g., a coil immersed in a bath of liquid cryogen, which is usually of the same composition as the liquid cryogen passing through the coil. Maintaining the bath at atmospheric pressure is sufficient for the bath to, in turn, maintain the liquid cryogen in the coil at the about one atmosphere equilibrium pressure.

In step (iii), the subcooled liquid cryogen is passed through a device, which can be a fine orifice or throttling valve, having a flow coefficient in the range of about 0.0002 to about 0.005 and preferably in the range of about 0.0007 to about 0.003. While the liquid cryogen passes through the device, the device is externally cooled, for example, with a liquid cryogen, again, having the same composition as the subcooled cryogen. This external coolant is preferably kept at atmospheric pressure. It will be apparent that the liquid cryogen used for subcooling and the one used for externally cooling the device can be one and the same. Thus, the heat exchange coil and the device can be submerged in a single bath of liquid cryogen open to the atmosphere. While the pressure on the liquid cryogen can be raised, this will only raise its temperature and defeat the effort to keep the liquid cryogen passing through the device essentially in the liquid phase.

A pressure drop occurs in step (iii), the liquid cryogen falling from line pressure to the use point pressure as it passes through the orifice or the throttling device. While the use point pressure may change as the heat load on the die varies, it is found that the flow through the device remains about constant. For example, when the heat load increases in the die as the wire is being drawn through it, more liquid cryogen is vaporized, and this increases the pressure drop in the die and, in turn, in the device in step (iii).

The "flow coefficient" is defined as the flow of water at 60° F. that would occur through an orifice in gallons per minute at one pound of pressure drop across the orifice.

In step (iv), the liquid cryogen, which has passed through the fine orifice or throttling device, has been subjected to the pressure drop, and is now at a lower pressure, is passed through an insulated tube having an internal diameter in the range of about 0.020 inch to about 0.200 inch and preferably about 0.040 inch to about 0.080 inch to the use point. The use of the term "internal diameter" suggests a cylindrical tube, but a tube of any shape with the same cross-sectional area can be used, if desired. The distance from the liquid cryogen supply to the use point or the length of the tube used in step (iv) is dictated only by the bounds of practicality. Straight tubes are preferred over coiled or curved tubes, however. Typical tube lengths are in the range of 10 to 100 feet, the shorter distances being preferred because of both economics and the reduction in risk of failure.

Materials of which the heat exchange coil, the throttling valve, and the tube can be made are as follows: AISI 300 series stainless steel, brass, bronze, copper, and aluminum. The insulation for the tube can be made of flexible polyurethane foam and the thickness of the insulation is typically in the range of about 0.3 inch to about 0.8 inch. In sum, both the materials with, and the apparatus in, which subject process can be practiced are conventional. A description of a typical throttling valve contemplated for use in subject process follows: Whitey Company micro-metering valve catalog number 21RS2, 0.020 inch orifice, maximum flow coefficient 0.007.

The following examples illustrate the invention:

EXAMPLE 1

This example shows the calculation of the maximum line pressure required where subject process is used to provide liquid nitrogen to a wire die cooling apparatus. Process steps and conditions and apparatus are considered to be as set forth above using the preferred aspects where mentioned. Specifics are as follows:

Subcooling is carried out at an equilibrium pressure of one atmosphere; the flow coefficient of the throttling valve is 0.0015 (when throttled); the liquid nitrogen used for subcooling and for externally cooling the throttling valve is maintained at one atmosphere pressure; and the insulated tube has an internal diameter of 0.042 inches.

A wire die cooling apparatus normally requires an inlet pressure of 20 psig and a flow of liquid nitrogen of six pounds per hour; however, during certain periods of operation, a 30 psig inlet pressure (operating pressure) is required and at other times an inlet pressure of 6 psig inlet pressure will suffice. It is desired to maintain the flow essentially constant at 6 pounds per hour ±5 percent over the range of inlet pressures 6 psig to 30 psig.

The minimum supply pressure can be calculated using the following formula:

$$A = \frac{BD - C}{B - 1}$$

wherein:

A=minimum line pressure in psig $$B = \frac{E^2}{F^2}$$

C=normal pressure required at use point in psig=20

D=maximum and minimum (use point operating) pressure required at use point in psig=30 and 6.

E=normal flow rate (associated with C) at use point in pounds per hour =6.

F=minimum and maximum flow rate allowable (associated with D) at use point in pounds per hour =5.7 and 6.3 (±5 percent of 6 pounds per hour)

The calculation is carried out twice, once for maximum pressure and minimum flow rate and the other for minimum pressure and maximum flow rate. The highest value of A obtained is the minimum required line pressure.

$$B = \frac{(6)^2}{(5.7)^2} = 1.108 \quad (1)$$

$$A = \frac{1.108 \times 30 - 20}{1.108 - 1} = 122.6$$

$$B = \frac{(6)^2}{(6.3)^2} = 0.907 \quad (2)$$

$$A = \frac{0.907 \times 6 - 20}{0.907 - 1} = 156.5$$

Therefore, the minimum required line pressure is 156.5 psig.

EXAMPLES 2 TO 4

Subject process is carried out using the preferred steps and conditions and the apparatus described above. The objective is to deliver liquid nitrogen to a wire die for the purpose of cooling the die.

The maximum use point operating pressure is 18 psig. The liquid nitrogen is subcooled to an equilibrium pressure of one atmosphere. The throttling valve has a flow coefficient of 0.0015 and is cooled externally to minus 320° F. with the same liquid nitrogen that provides the subcooling. This liquid nitrogen is maintained at one atmosphere pressure. The insulated tube has an internal diamter of 0.125 inch.

The variables are as follows:

| Example | heat on die (watts) | line pressure (psig) | line pressure between subcooler and throttling valve (psig) | pressure between throttling valve and die (psig) | flow rate (pounds per hour) (±5%) | liquid/vapor exiting die (in percent) |
|---|---|---|---|---|---|---|
| 2 | 74 | 178 | 177 | 13 | 6.9 | 57/43 |
| 3 | 143 | 170 | 169 | 18 | 6.6 | 13/87 |
| 4 | 25.2 | 170 | 169 | 7.3 | 7.0 | 86/14 |

I claim:

1. A process for delivering a liquid cryogen to a use point in an essentially liquid phase at an about constant flow rate in the range of about 1 to about 40 pounds per hour, said use point having a variable internal pressure drop, comprising the following steps:

(i) providing said liquid cryogen at a line pressure in the range of about 4 to about 10 times the maximum use point operating pressure;

(ii) subcooling the liquid cryogen of step (i) to an equilibrium pressure of no greater than about one atmosphere while maintaining said line pressure;

(iii) passing the liquid cryogen of step (ii) through a device having a flow coefficient in the range of about 0.0002 to about 0.005 while cooling said device externally to a temperature, which will maintain the liquid cryogen in essentially the liquid phase; and (iv) passing the liquid cryogen exiting the device in step (iii) through an insulated tube having an internal diameter in the range of about 0.020 inch to about 0.200 inch to the use point.

2. The process defined in claim 1 wherein:

(a) the constant flow rate is in the range of about 4 to about 20 pounds per hour;

(b) the line pressure is about 8 to about 10 times the maximum use point operating pressure;

(c) the flow coefficient is in the range of about 0.0007 to about 0.003; and (d) the internal diameter is about 0.040 inch to about 0.080 inch.

* * * * *